United States Patent [19]

Reyner

[11] 4,436,203

[45] Mar. 13, 1984

[54] TAMPER RESISTANT PACKAGING DEVICE

[75] Inventor: Ellis M. Reyner, New Brunswick, N.J.

[73] Assignee: Joy Research Incorporated, New Brunswick, N.J.

[21] Appl. No.: 493,363

[22] Filed: May 10, 1983

[51] Int. Cl.[3] ..... B65D 81/20; B65D 85/86; G01L 19/12

[52] U.S. Cl. ..... 206/524.8; 206/216; 206/457; 206/807; 150/55; 215/1 C

[58] Field of Search ..... 206/524.8, 216, 45.33, 206/45.34, 457, 497, 807; 215/1 C; 150/0.5

[56] References Cited

U.S. PATENT DOCUMENTS

| | | | |
|---|---|---|---|
| 2,287,495 | 6/1942 | Moyers | 206/45.34 |
| 2,717,661 | 9/1955 | Mayfield | 206/216 |
| 2,821,951 | 2/1958 | Carver | 206/216 |
| 3,083,877 | 4/1963 | Gash | 215/1 C |
| 3,143,429 | 8/1964 | Swanson et al. | 206/45.33 |
| 3,185,353 | 5/1965 | Mercer | 215/1 C |
| 3,301,293 | 1/1967 | Santelli | 150/0.5 |
| 3,307,318 | 3/1967 | Bauman | 206/497 |
| 3,502,204 | 3/1970 | James | 206/45.34 |
| 4,051,265 | 9/1977 | Kirshenbaum et al. | 206/497 |
| 4,295,566 | 10/1981 | Vincek | 206/457 |

*Primary Examiner*—William T. Dixson, Jr.
*Attorney, Agent, or Firm*—Mathews, Woodbridge, Goebel, Laughlin, Pugh & Collins

[57] ABSTRACT

An inner enclosure of a predetermined size, design and construction loaded with a product and pressurized with a flowable material before said inner enclosure is closed, said inner enclosure is enclosed within a flexible outer enclosure, and said outer enclosure is closed after its internal pressure is reduced below that of the surrounding atmospheric pressure. In the event the product is tampered with through apertures in the walls of the package, the package will manifest evidence which will alert the consumer of the possibility that the product may have been tampered with.

33 Claims, 17 Drawing Figures

FIG. 1
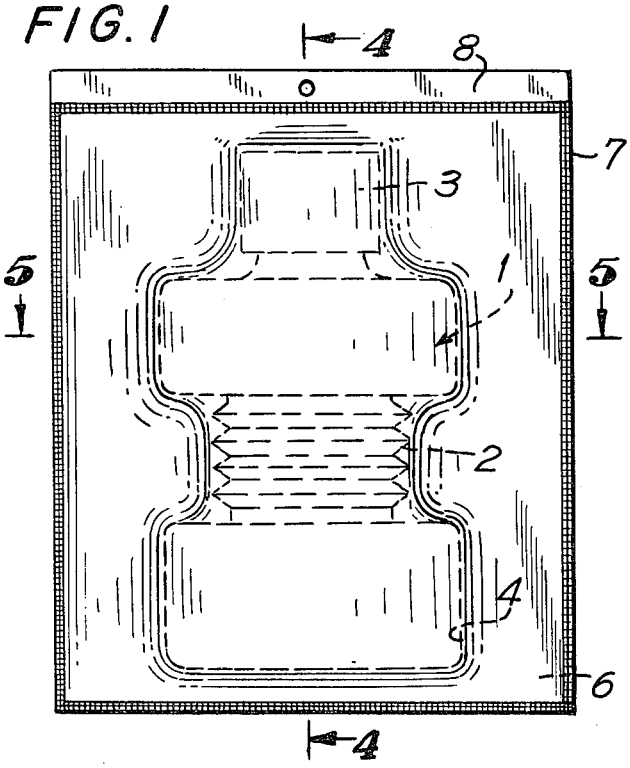
FIG. 4
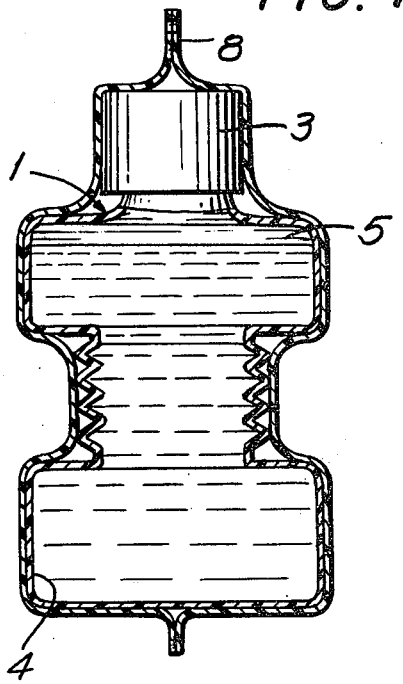
FIG. 5
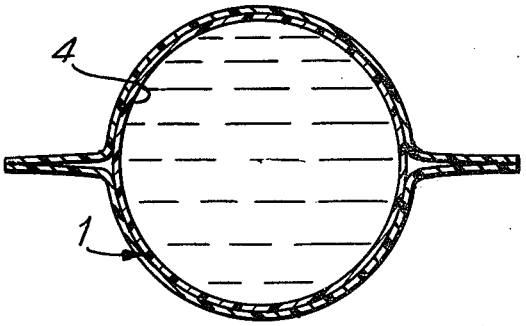
FIG. 2
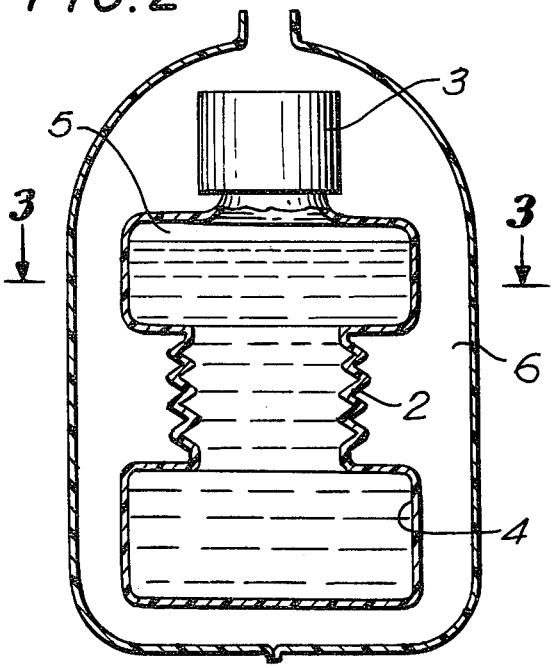
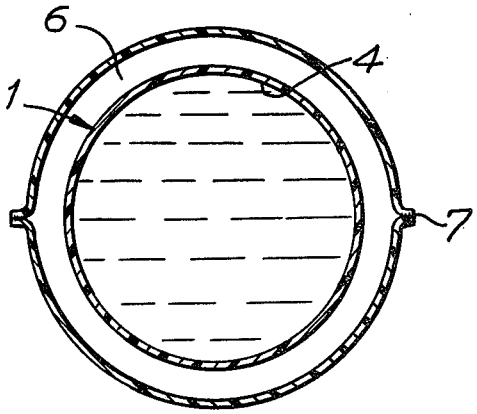
FIG. 3

FIG. 10
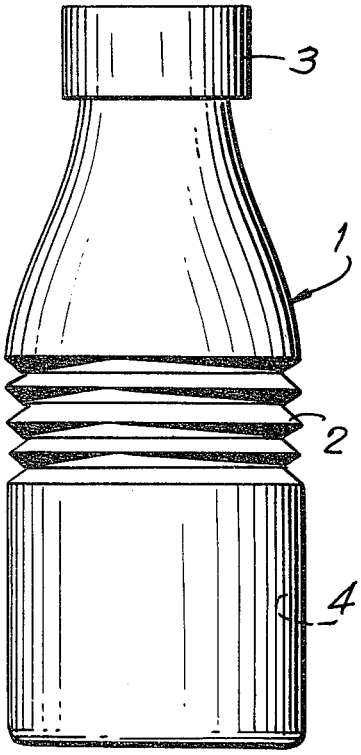
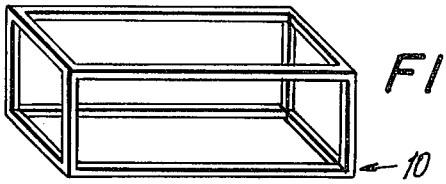
FIG. 16
FIG. 11
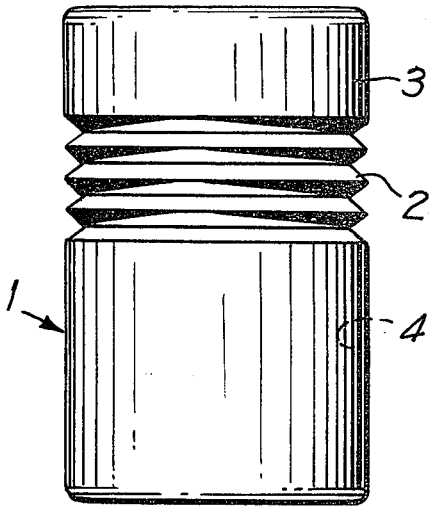
FIG. 12
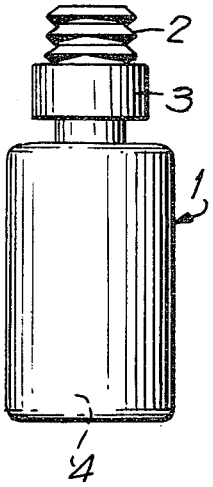
FIG. 13
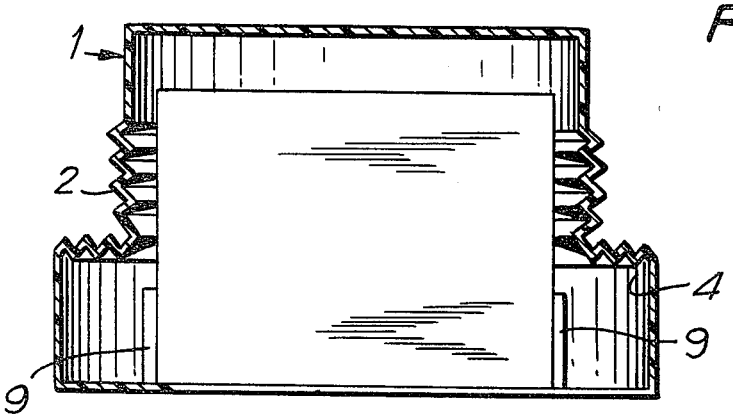
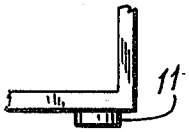
FIG. 17
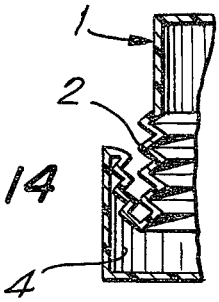
FIG. 14
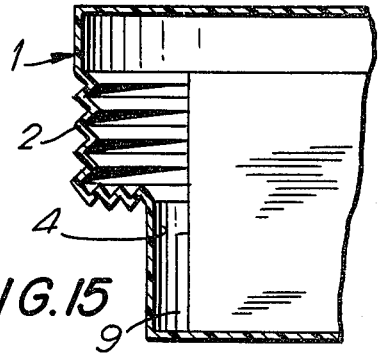
FIG. 15

TAMPER RESISTANT PACKAGING DEVICE

BACKGROUND OF THE INVENTION

For some time, there has been a need for tamper-resistant packaging for consumer products and consumer product packaging processes, which have features capable of alerting the consumer in the event that there is a possibility that the contents of a package had been acessible or tampered with after manufacturing.

The life style of our society has been changing and the need for a practical and economical tamper resistant packaging and process has become a necessity in our daily life.

A common problem with the so called "Tamper-Resistant Packaging" which are currently on the market is that even though products are packaged in a shrink wrap, strip-pack, or a blister pack, they nevertheless can be contaminated with toxic chemicals or other foreign materials through a conduit opened in the package by means of thin hypodermic needles or the like, or by dissociating the adhesive seals of the package. Such conduit opening cannot readily caution the average consumer, who is normally inexperienced in detecting packaging imperfections of this sort. The present invention provides packaging which overcomes the above mentioned deficiencies of the prior art and provides additional novel features and advantages, and a wider range of uses than were possible with devices used heretofore.

BRIEF SUMMARY OF THE INVENTION

Packaging means capable of manifesting evidence in the event that apertures are made in its walls, and thus alert the purchaser of the possibility that the product therein had been tampered with, comprising an inner enclosure of suitable size, design, and construction, which holds the product and means therein which permit raising its internal pressure higher than the surrounding atmospheric pressure, said inner enclosure is enveloped by an outer enclosure of suitable size, design and construction, and its internal pressure is reduced below that of the surrounding atmosphere before it is closed. Upon reaching the contents in the package through apertures in the outer and inner enclosures, the internal pressures therein will be disturbed and the package will manifest evidence of the possibility that the product had been tampered with, and thus caution the purchaser against buying it.

One object of this invention is to package a product within a tamper-resistant packaging, and in the event it is tampered with, the package will manifest evident changes which would caution the purchaser.

Another object of this invention is to package a product within an economical and effective tamper-resistant packaging, which can be offered to the public at reasonable prices.

Another object of the present invention is to provide a practical and economical tamper-resistant packaging which can be utilized in various packaging sizes and designs.

A further object of the present invention is to provide a practical and economical tamper-resistant packaging devices and packaging processes which take into consideration consumers with certain problems such as arthritis sufferers.

A further object of this invention is to provide practical and economical tamper-resistant packaging devices, which are more effective than those originally suggested by the FOOD AND DRUG ADMINISTRATION (FDA).

Other objects of the precise nature of the present invention will become evident from the following description and accompanying drawings in which each of the various components have the same reference numeral in the different views.

DESCRIPTION OF THE DRAWINGS

FIG. 1. Is a front view of the tamper-resistant package including inner enclosure (1), and shows bellows shaped foldings (2) section of the walls of internal enclosure (1), which is enclosed within outer enclosure (7).

FIG. 2. Is a vertical section of FIG. 1 showing an open outer flexible bag (7) enclosing the inner enclosure (1) and its interior (4) and a wide space between them. Enclosure (1) has extendable bellows shaped foldings (2) in sections of its walls.

FIG. 3. Is a horizontal section of FIG. 1 at a certain level showing the internal enclosure (1) inside the outer enclosure (7) before it is closed, and space (6) is between them.

FIG. 4. Is a vertical section of this package showing outer flexible bag (7) closed after it was properly evacuated and its internal pressure is reduced below that of the surrounding atmosphere, and the size of space (6) is reduced in comparison to the size shown in FIG. 2.

FIG. 5. Is a horizontal section of FIG. 4 showing the size of space (6) reduced in comparison to that shown in FIG. 3 after outer enclosure (7) had been properly evacuated and closed.

FIGS. 6,7,8,9,10,11, and 12 show alternative shapes and sizes of the internal enclosure (1) including the possible sizes and locations of the bellows shaped foldings (2) which may also be integrated in closure (3).

FIG. 13. Shows another variation in the construction and location of the bellows shaped foldings (2) of the inner enclosure (1), which includes cushions (9), which would be properly designed to hold the product within a predetermined space.

FIG. 14. Shows the bellows shaped foldings (2) are designed to settle within enclosure (1) when compressed.

FIG. 15. Shows the bellows shaped foldings (2) are designed to settle outside inner enclosure (1) when compressed.

FIG. 16. Shows a skeleton framework means structure (10).

FIG. 17. Shows one bulge (11) on the skeleton framework means structure (10).

Each of the various components in the various figures and views have the same reference numerals as in FIGS. 1 to 17.

DETAILED DESCRIPTION

Figure 6:
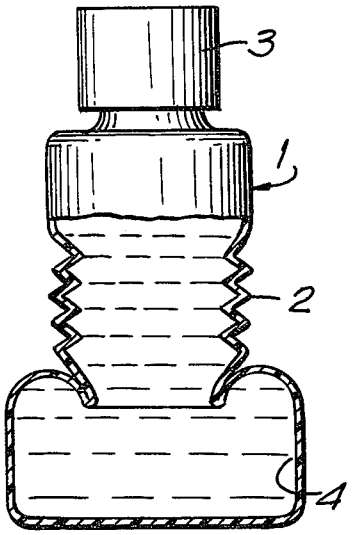

The illustrative embodiment of FIG. 1 comprises an inner enclosure (1) of any suitable design shape and size, and is closed with closure (3) which is of the type of child resistant closure or any other closure which is replaceable with a child resistant closure.

Portions of the walls of either the internal enclosure (1) or closure (3) or both are suitably foldable and may be of various sizes and designs which may resemble the shape of bellows (2). The contents of the interior space (4) inside enclosure (1) may be solid, semi-solid, liquid or gaseous material, and above it is head space (5), which would contain a predetermined quantity of flowable material which would sustain the bellows like foldings (2) in an unfolded extended position, and expands the size of said inner enclosure (1) to a predetermined volume before closing it. The bellows shaped foldings associated with enclosure (1) and cap (3) have the capacity for holding enough flowable material which would cause the internal pressure therein to exceed a predetermined range of pressure when said bellows shaped foldings are conveniently compressed. Outer flexible pouch-like enclosure (7) is made of any suitable size shape and construction and encloses enclosure (1) and forms space (6) in between, and holds at least one flowable material which may be liquid or gas. Outer enclosure (7) is evacuated to a predetermined degree and its internal pressure drops below that of the surrounding atmospheric pressure and is permanently closed at area (8).

Each inner enclosure (1) and outer flexible bag-like (7) would maintain their predetermined volume and pressure as long as they remain closed and untampered with under the same atmospheric conditions.

Shown in FIGS. 2 and 3 are outer flexible bag (7) in an open position, the contents in space (4) is liquid and on top of it is head space (5) which contains gas. The walls of outer enclosure (7) do not touch or press against the walls of the inner enclosure (1), and thus its free movement therein would not be restricted.

In the illustrative embodiments of FIGS. 4 and 5, enclosure (7) which encloses enclosure (1) has been evacuated and its internal pressure has been suitably reduced to a level below that of the surrounding atmospheric pressure before it was permanently closed. The partial vacuum within outer enclosure (7) would confine and seize and cushion structure (10) and inner enclosure (1) and restrain and limit their movement therein to a predetermined degree. Its walls touch and press against the walls of inner enclosure (1). The movement of enclosure (1) within enclosure (7) is restricted to a predetermined degree.

Figure 7:
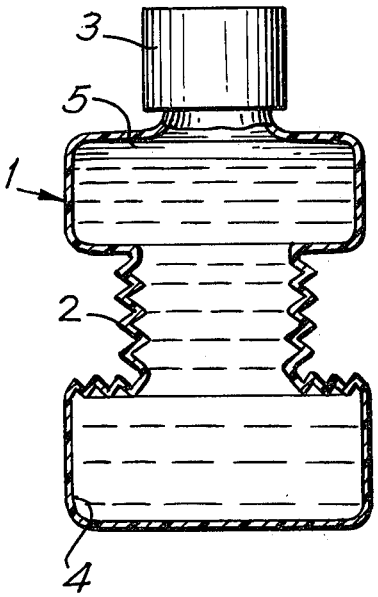
Figure 8:
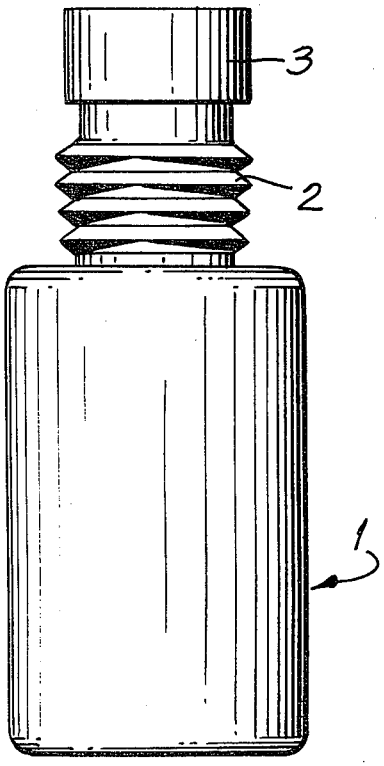
Figure 9:
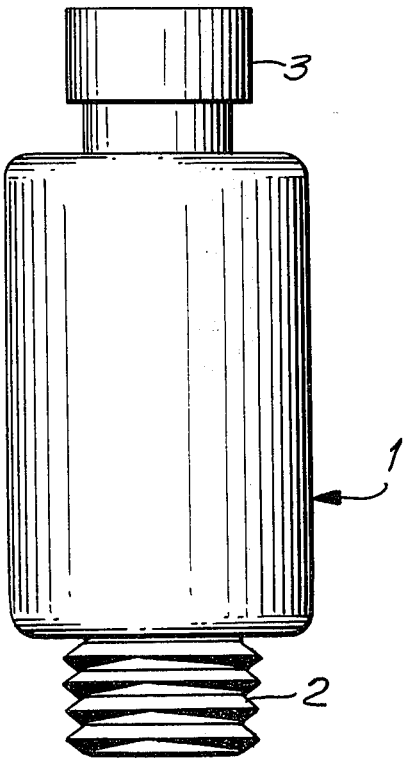

The illustrative embodiments in FIGS. 6,7,8,9,10,11,12,13,14, and 15 show variations of containers and closures which conform with all the specifications of the inner enclosure (1) and closure (3) mentioned above. At least one of the bellows-like foldings (2) in either container (1) or closure (3) can be suitably compressed and result with raising its internal pressure and reducing its size. Foldings (2) may be constructed in various suitable designs, sizes and locations, and compressed to settle on top of one another as in FIGS. 7,8,9,10,11, and 12, or settle within the container as in FIGS. 6,13, and 14, or outside the container as shown in FIG. (15).

Filling a product in a tamper-resistant package of this type involves the following steps:

Step I.

Transfer the required quantity of the product into enclosure (1).

Step II.

Close enclosure (1) after transferring into it a predetermined quantity of flowable material enough to cause foldings (2) to unfold and increase the size of enclosure (1) to a predetermined volume.

Step III.

Place enclosure (1) as described in Step II inside enclosure (7). Evacuate the flowable contents of enclosure (7) and reduce its internal pressure to a predetermined level below the surrounding atmospheric pressure, in which condition the movement of enclosure (1) within the enclosure (7) would be limited to a predetermined degree due to the pressure exerted by the walls of enclosure (7) on the walls of enclosure (1). Close enclosure (7) with a permanent closure.

In another embodiment, the inner enclosure (1) which holds the product, as described above, is lodged within a skeleton framework structure means (10) which is illustrated in FIG. (16). An oversize flexible outer enclosure (7) envelopes structure (10) including enclosure (1) and is closed by means of suitable permanent closing device after evacuating its contents and reducing its internal pressure to a predetermined pressure level below that of the surrounding atmosphere. At least one bulge (11) extends from the skeleton framework structure type (10) at a convenient location as shown in FIG. (17).

In the manufacturing process, parts of the flexible walls of the oversize enclosure (7) would be sucked in, within the extremeties and reaches of bulges (11) and structure (10), and their sizes would be reduced, and thus allow the manufactured packages to assume nearly uniform shapes which may allow them to be stacked up.

In another embodiment of tamper-resistant packaging not shown in the drawings, flexible enclosure means (1) which holds the product is suitably pressurized to a predetermined pressure level above that of the surrounding atmosphere with at least one suitable flowable material, and is fitted with a closure member (3) of the type referred to in the trade as "Child-resistant closure," or it is fitted with closure means replaceable by such child-resistant closure means.

Under normal temperatures and pressures, and whether it is closed or opened, the unpressurized flexible enclosure means (1) which holds the product, has the characteristics whereby upon applying on the exterior of its walls a predetermined pressure within a range equivalent to that of a human hand squeeze, it becomes soft, flexible and yields or caves in, and at least one of the following will occur:

A. At least one portion of the walls will yield.

B. At least one section of the walls will cave in.

C. At least one section of the walls will be damaged.

D. Its size will be reduced.

Under normal temperatures and pressures, the pressurized flexible enclosure means (1) which holds the product has the characteristics whereby upon applying on the exterior of its walls a predetermined pressure within the range equivalent to that of a human hand squeeze, no portion of its exterior walls will yield or cave in to the same degree mentioned above, and the enclosure remains comparatively rigid and unflexible to the same degree as manifested by such pressurized packages which are properly manufactured.

In another embodiment of tamper resistant packaging device not shown in the drawings, the product is encased within an enclosure before it is placed within the enclosure which holds the product.

In another embodiment of tamper resistant packaging device not shown in the drawings, the enclosure which holds the product or the encased product is not pressurized.

Outer enclosure (7) is of any suitable size, design or shape and is constructed from at least one or more suitable materials which may be rigid, semi-rigid, flexible, metal alloy, metallic foils, glass, fibre-glass, cardboard, cork, plastic-like cured rubber, rubber, impervious, non-impervious, permeable, non-permeable, stretchable, non-stretchable, laminated, non-laminated, elasticated, non-elasticated, lined, non-lined, multi-film, single film, with or without foil, single layer, multi-layer, specially treated or non-treated fabric, or any other suitable materials which may be available on the market, and at least one portion of the walls of said enclosure (7) is conveniently flexible.

Inner enclosure (1) is of any suitable size, design or shape, and is constructed from one or more suitable materials of the type specified for construction of outer enclosure (7). At least a portion of its walls may be flexible and may be foldable. The folds may be of any suitable size, design, shape and construction and may assume the form of bellows. The interior (4) of inner enclosure (1), which holds the product may be suitably shaped to cushion and restrict the movement of its content to a predetermined degree within a limited space.

Bellows (2) may be of any suitable size, shape, design and capacity, and can be conveniently stretched to increase the holding capacity of enclosure (1) in excess of a predetermined size, and when compressed, it should cause the internal pressure of enclosure (1) to rise above a predetermined pressure level and enables the package to perform properly. Said bellows are constructed from at least one suitable flexible material which conforms with the specifications of the flexible materials associated with enclosure (1) mentioned above.

Closure means (3) of enclosure (1) may be of any suitable size, design, or shape, removeable or permanent, with or without bellows, and it may conform with the specifications of what is known in the trade to be "Child-resistant closure," or it may be replaceable by a child resistant closure means. It is constructed from one or more suitable materials such as those specified for the construction of inner enclosure (1).

Permanent closing device means associated with enclosure (7) at area (8) and may be associated with enclosure (1), may be any suitable device such as crimping, fusing, heat sealing or gluing.

The flowable material loaded into enclosure (1) which contains the product or into outer enclosure (7) is constituted from at least one single chemical entity or from a mixture of single chemical entities which may be in a state of gas or in a state of liquid, or in the state of a combination of both gas and liquid under the pressure and temperature conditions which said package would exist and would be handled during manufacturing, distribution and retail display. The flowable material should not constitute part of the finished product or related to or constitute any of its ingredients or contribute or add or reduce or modify or alter any of its physical or chemical characteristics, such as color, odor, taste, consistency or texture or any other characteristics for which the product is intended to be utilized. In the event that the product itself has the characteristics which enables it to perform the functions of the flowable material, an additional flowable material may not be required.

Skeleton framework structure means (10) is of any suitable size, shape and design, and constructed from one or more suitable materials such as those specified for the construction of outer enclosure (7), and is capable of supporting the outer flexible (7) under the surrounding atmospheric pressures and temperatures, and continues to do so during manufacturing, distribution and retail display. Skeleton framework means (10) may constitute an integral part of enclosure (1). At least one bulge (11) is located on the exterior surface of skeleton framework means (10), which may be an integral part of it.

Said tamper-resistant packaging means has at least one distinguishing proprietary means which may be associated with its shape, design, markings, or graphic characteristics such as a trade mark or a logo which is not readily available on the market, and which provides an indication of package integrity and remains intact during manufacturing, distribution and retail display. This distinguishing proprietary means functions as a barrier to entry to the product, and, if destroyed, broken, breached, or missing, it can easily be expected to provide visual, mechanical, odorous, or any other means of evidence to indicate to the consumer that tampering with the product may have occurred.

This package may contain a statement prominently placed which remains intact in the event that the package is tampered with, which statement is intended to alert the consumer to the specific tamper-resistant features which would indicate the possibility that tampering may have occurred, and recommends against purchasing that particular package.

The flowable material as well as all the other component parts of this tamper-resistant packaging means may be of the type which can be sterilized.

In the event that the content of inner enclosure (1) is tampered with through at least one aperture made in each of flexible pouch-like (7) and inner enclosure (1), at least either the predetermined volume or the pressure or both in enclosures (1) and (7) would be disturbed, and cause the package to manifest at least one of the following indications, which would serve to caution the consumer of the possibility that the package had been tampered with:

1. When said package is subjected to a predetermined pressure level equivalent to that of a human hand squeeze on the exterior of its walls, at least one of the following results would be manifested:

a. At least a portion of its walls would yield.
b. At least a portion of its walls would cave in.
c. At least a portion of its walls would be damaged.
d. The size of the enclosure which holds the product will be reduced and its internal pressure will rise and upon freeing it from said pressure, it will not regain its original capacity.
e. The internal pressure in the outer enclosure will rise.
f. The volume and pressure of said outer enclosure will increase.

2. Upon pulling outwardly at least a portion of the walls of the package, said outer enclosure grows in size and would not be restored to its original smaller capacity when said outwardly pulling stops.

3. In the package means, the inner enclosure which contains the product would move within the outer enclosure easily and freely beyond the predetermined extent of the movement of its counterpart in a properly manufactured package which has not been tampered with.

4. Discharge of the package contents out of outer enclosure (7) or inner enclosure (1) or out of both enclosures may become evident.

5. At least one of the characteristic color, odor, design, or texture of the package will change.

The radio-activity of the materials utilized in this tamper-resistant package should be within human tolerance.

While certain illustrative embodiments of the invention have been described in particularity, it will be understood that various other modification will be readily apparent to those skilled in the art without departing from the scope and spirit of the invention. Accordingly, it is not intended that the scope of the claims appended hereto be limited to the description set forth herein but rather that the claims be construed as encompassing all equivalents of the present invention which are apparent to those skilled in the art to which the invention pertains.

What is claimed is:

1. In a tamper-resistant package, at least one over sized closeable outer enclosure and at least one inner enclosure fitted with closure means containing at least one flowable material in addition to the product, and means associated with said package for making available higher pressure inside the inner enclosure than that of its surrounding atmosphere, space between said outer and inner enclosures contains a predetermined amount of flowable material suitable for the proper functioning of said package, the internal pressure in said outer enclosure is reduced to a predetermined level below that of its surrounding atmosphere by drawing out a suitable quantity of its flowable contents before closing it, the walls of said outer enclosure press against the walls of said inner enclosure which holds the product and restricts its movement therein to a predetermined extent, means associated with said package for manifesting evidence that tampering with said package has occurred in the event that the contents in said inner enclosure is tampered with through at least one aperture made in said walls of said package leading to the product therein.

2. In a tamper resistant packaging device, at least one over sized closeable outer enclosure and at least one inner enclosure fitted with closure means containing at least one flowable material in addition to the product, space between said outer and inner enclosures contains a predetermined amount of flowable material suitable for the proper functioning of said package, the internal pressure in said outer enclosure is reduced to a predetermined level below that of its surrounding atmosphere by drawing out a suitable quantity of its flowable contents before closing it, the walls of said outer enclosure press against the walls of said inner enclosure which holds the product and restricts its movement therein to a predetermined extent, means associated with said package for manifesting evidence that tampering with said package had occurred in the event that the contents in said inner enclosure is tampered with through at least one aperture made in said package leading to the product therein.

3. In the combination defined in claim 1 or 2, wherein said inner enclosure holding the product is lodged within a suitable skeleton framework type structure and together they are enveloped inside said outer enclosure, at least one conduit suitably located and associated with said skeleton framework type structure capable of facilitating the free flowing of said flowable material within said outer enclosure, the internal pressure in said outer enclosure is reduced to a predetermined level below that of the surrounding atmosphere by drawing out enough quantity of its flowable contents before closing said outer enclosure, the walls of said outer enclosure are sucked inwardly within the edges of said skeleton framework type structure and the bulges thereon, means associated with said package for manifesting evidence in the event that the contents of the inner enclosure is tampered with through at least one aperture made in said walls of said package leading to the product therein.

4. In a tamper-resistant package type, a flexible enclosure means fitted with closure means holding at least one flowable material including the product, the internal pressure in said flexible enclosure means is at a predetermined pressure level higher than that of its surrounding atmosphere, means associated with said package for manifesting evidence in the event that the contents of the inner enclosure is tampered with through at least one aperture made in said flexible enclosure means.

5. In the combinations defined in claim 1, 2, 3, or 4, wherein the product is encased within an enclosure before it is placed within the enclosure which holds the product.

6. The combinations defined in claim 1, 2, 3, 4, or 5 wherein said flexible outer enclosure means is supported by a suitable skeleton framework type structure from within.

7. The combinations defined in claim 1, 2, 3, 5, or 6, wherein said flexible outer enclosures are lodged within suitable skeleton framework type structures.

8. The combination defined in claim 7, wherein said contents in said enclosure are cushioned and their movements are restricted therein.

9. In the combinations defined in claim 1, 2, 3, 4, 5, 6, 7, or 8, wherein said closure means and enclosure means which hold the product are capable of retaining said predetermined internal pressure during manufacturing, distribution and retail display.

10. In the combinations defined in claim 1, 2, 3, 4, 5, 6, 7, 8, or 9, wherein at least one portion of the walls of said closure means and enclosure means which contain the product is flexible.

11. In the combination defined in claim 10, wherein at least one portion of said flexible portion of walls is foldable.

12. In the combination defined in claim 11, wherein at least one portion of said foldable portion of said walls is conveniently located and is of suitable design, size, flexibility and capacity for holding large enough quantities of said flowable material and is capable of carrying out its functions properly in said package.

13. In the combination defined in claim 12, wherein said foldable walls have bellows-like designs.

14. In the combination defined in claim 3, wherein at least one bulge of suitable size and shape is suitably located on said skeleton framework type structure.

15. In the combinations defined in claim 3 or 14, wherein said conduit is a groove like passage of suitable size and shape formed between the touching surfaces of said skeleton framework type structure and the inner surfaces of said outer enclosure facilitates the free flowing of said flowable material therein.

16. In the combinations defined in claim 3, 14, or 15, wherein said skeleton type framework structures are integral parts of the inner enclosure.

17. In the combinations defined in claim 1, 2, 3, 4, 5, 6, 7, 8, 9, 10, 11, 12, 13, 14, 15, or 16, wherein said closures, enclosures which hold the product, skeleton framework type structures, and outer closures means are designed in convenient shapes and sizes and constructed from suitable materials which enable each of them to carry out its specific functions in said packages properly.

18. In the combinations defined in claim 1, 2, 3, 4, 5, 6, 7, 8, 9, 10, 11, 12, 13, 14, 15, 16, or 17, wherein said flowable material included inside the enclosure which holds the product is at least one of the components of a suitable combination of liquid and gas under the pressure and temperature conditions in which the package would be handled during manufacturing, distribution and retail display, each of said gas and liquid components is composed of at least one single chemical entity, said flowable material is extrinsic and unrelated to the product.

19. In the combination defined in claim 18, wherein said product has the characteristics which enables it to perform those functions of the flowable material, an additional flowable material is not required.

20. In the combinations defined in claim 1, 2, 3, 4, 5, 6, 7, 8, 9, 10, 11, 12, 13, 14, 15, 16, 17, 18, or 19, wherein said flowable material included inside the outer enclosure is at least one of the components of a combination of liquid and gas under the pressure and temperature conditions in which the package would exist during manufacturing, distribution, and retail display, each of said component of gas and liquid is composed of at least one single chemical entity.

21. In the combinations defined in claim 18, 19, or 20, wherein the components of said flowable materials are compatible and do not alter any of the characteristics of the materials in their surroundings.

22. In the combinations defined in claim 18, 19, 20, or 21, wherein the package is characterized by at least one distinguishing proprietary characteristic which is not readily available on the market.

23. In the combination defined in claim 22, wherein said package has at least one proprietary characteristic selected from the class of characteristics consisting of shape, design, color, odor, texture, markings and graphics.

24. In the combinations defined in claim 22 or 23, wherein in the event that said distinguishing proprietary characteristics of the package is ripped, broken, breached or missing, said package will manifest evidence of said imperfection.

25. In the combinations defined in claim 21, 22, 23, or 24, wherein said flexible enclosure which holds the product is pressurized by a predetermined quantity of said flowable material and its internal pressure is raised to a predetermined pressure level above that of its surrounding atmosphere before it is closed.

26. In the combination defined in claim 25, wherein the internal pressure in said enclosure which holds the product is raised to a predetermined level above that of its surrounding atmosphere by compressing it and reducing its volume to a predetermined capacity after it is closed.

27. In the combination defined in claim 25 or 26, wherein the internal pressure within said enclosure which contains the product is within the range of one to two hundred (1 to 200) pounds per square inch under one atmospheric pressure and 15 degrees centigrade conditions.

28. In the combinations defined in claim 25, 26, or 27, wherein durable informative statements recorded on durable labels of proper design and construction and properly located in said package and remain part of it notwithstanding that said package had been tampered with, said informative statements inform the purchaser about the evidence to look for which would be manifested in the package in the event it was tampered with.

29. In the combination defined in claim 28, wherein, said informative statements advise against the purchase of packages which manifest evidence that possible tampering had occurred therewith.

30. In the combinations defined in claim 27, 28, or 29, wherein said package will manifest at least one of the following indications only in the event that the product therein is tampered with through at least one opening made in the walls of said package leading to the product, said indications cannot be manifested by a properly manufactured package which had not been tampered with:

1. when said package is subjected to a predetermined pressure level equivalent to that of a human hand squeeze on the exterior of its walls, at least one of the following results would be manifested:
   a. at least a portion of its walls would yield;
   b. at least a portion of its walls would cave in;
   c. at least a portion of its walls would be damaged;
   d. the size of the enclosure which holds the product will be reduced and its internal pressure will rise and upon freeing it from said pressure, it will not regain its original capacity;
   e. the internal pressure in the outer enclosure will rise;
   f. the volume and pressure of said outer enclosure will increase;
2. upon pulling outwardly at least a portion of the walls of the package, said outer enclosure grows in size and would not be restored to its original smaller capacity when said outwardly pulling stops.
3. the inner enclosure which contains the product would move within the outer enclosure easily and freely beyond the predetermined extent of the movement of its counterpart in a properly manufactured package which has not been tampered with;
4. the discharge of the package contents may become evident;
5. at least a change in one of the class of characteristics of shape, design, color, odor, and texture of the package will become evident.

31. In the combination defined in claim 30, wherein, at least the closure associated with the enclosure which holds the product or the replacement of said closure is of the type characterized in the trade to be child resistant closure.

32. In the combinations defined claim 30 or 31, wherein all the component parts and materials associated with said tamper resistant packaging device are of the type which can be sterilized.

33. In the combinations defined in claim 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, or 32, wherein the radio-activity of the component parts of said package during production is within human tolerance.

* * * * *